US008147089B2

(12) United States Patent
Matthews et al.

(10) Patent No.: US 8,147,089 B2
(45) Date of Patent: Apr. 3, 2012

(54) SWITCHABLE LIGHT SOURCES

(75) Inventors: John W. Matthews, Newport Beach, CA (US); Michael D. Picciotta, Yorba Linda, CA (US); William Wells, Costa Mesa, CA (US)

(73) Assignee: SureFire, LLC, Fountain Valley, CA (US)

( * ) Notice: Subject to any disclaimer, the term of this patent is extended or adjusted under 35 U.S.C. 154(b) by 722 days.

(21) Appl. No.: 12/248,704

(22) Filed: Oct. 9, 2008

(65) Prior Publication Data

US 2010/0091485 A1 Apr. 15, 2010

(51) Int. Cl.
*F21L 4/04* (2006.01)

(52) U.S. Cl. ..... 362/199; 362/196; 362/197; 362/198; 362/200; 362/201; 362/202; 362/203; 362/204; 362/205; 362/206

(58) Field of Classification Search ..... 362/196–208
See application file for complete search history.

(56) References Cited

U.S. PATENT DOCUMENTS

| | | | | |
|---|---|---|---|---|
| D95,274 | S | 4/1935 | Levy | |
| D548,385 | S | 8/2007 | Sharrah et al. | |
| 7,273,292 | B2 | 9/2007 | Kim | |
| D567,894 | S | 4/2008 | Sterling et al. | |
| D568,508 | S | 5/2008 | Howe et al. | |
| D578,599 | S | 10/2008 | Cheng | |
| 7,441,918 | B2 | 10/2008 | Kim | |
| D581,586 | S | 11/2008 | Conroy | |
| D585,516 | S | 1/2009 | Smith | |
| 7,576,515 | B2 | 8/2009 | Greenslade | |
| D600,772 | S | 9/2009 | Swan | |
| 7,614,760 | B2 | 11/2009 | Sharrah et al. | |
| D612,970 | S | 3/2010 | Sharrah et al. | |
| D616,956 | S | 6/2010 | Hamilton | |
| 2004/0068913 | A1 | 4/2004 | Solinsky et al. | |
| 2005/0122711 | A1 | 6/2005 | Matthews et al. | |
| 2005/0122712 | A1* | 6/2005 | Kim | 362/184 |
| 2005/0157492 | A1* | 7/2005 | Chiu | 362/184 |
| 2005/0237737 | A1 | 10/2005 | Kim | |
| 2007/0034890 | A1 | 2/2007 | Daschner et al. | |
| 2007/0227056 | A1 | 10/2007 | Howe et al. | |
| 2008/0134562 | A1 | 6/2008 | Teetzel | |
| 2008/0155876 | A1 | 7/2008 | Matthews et al. | |
| 2008/0157114 | A1 | 7/2008 | Basin et al. | |
| 2010/0046211 | A1* | 2/2010 | Spartano et al. | 362/157 |
| 2010/0164401 | A1 | 7/2010 | Matthews et al. | |

FOREIGN PATENT DOCUMENTS

WO WO 2010/042756 4/2010

* cited by examiner

*Primary Examiner* — William Carter
(74) *Attorney, Agent, or Firm* — Haynes and Boone, LLP

(57) ABSTRACT

Various structures are provided that may be advantageously used in one or more illumination device designs. In one example, a lens is movable among a plurality of light sources to facilitate selection of which light source is used to provide light for the illumination device. In another example, electric power is provided only to the light source that is used to provide light for the illumination device. Rotation of a bezel of the light source can determine which light sources provides light for the light source and which light source receives electric power.

25 Claims, 5 Drawing Sheets

SWITCHABLE LIGHT SOURCES

BACKGROUND

1. Field of the Invention

The present invention generally relates to light producing devices and more particularly relates to light producing devices with switchable light sources.

2. Related Art

As is well known, light producing devices are typically configured to perform only a single function, namely, to illuminate areas of interest. For example, conventional flashlights are typically implemented with mechanical and electrical structures directed to performing this single function. Such flashlights typically include a generally cylindrical body that holds a power source and other related components. A head may be attached to the cylindrical body. For example, the head may be used to hold a light source, lens, and other related components.

Unfortunately, such conventional light producing devices have various limitations. For example, although such conventional light producing devices are useful for illumination with white light, there are often instances when illumination with other colors of visible light is desirable. There are also instances when illumination with infrared light or ultraviolet is desirable. Accordingly, there is a need for improved light producing devices that overcome one or more of the deficiencies discussed above.

SUMMARY

In accordance with embodiments further described herein, mechanical and electrical features are provided that may be advantageously used in one or more multiple light source designs. For example, in one embodiment, a lens is movable between different light sources of a light producing device. In another embodiment, rotating a bezel of a light producing device switches electric power between light sources. These and other features and advantages of the present invention will be more readily apparent from the detailed description of the embodiments set forth below taken in conjunction with the accompanying drawings.

BRIEF DESCRIPTION OF THE FIGURES

Like element numbers in different figures represent the same or similar elements.

DETAILED DESCRIPTION

Figure 1:
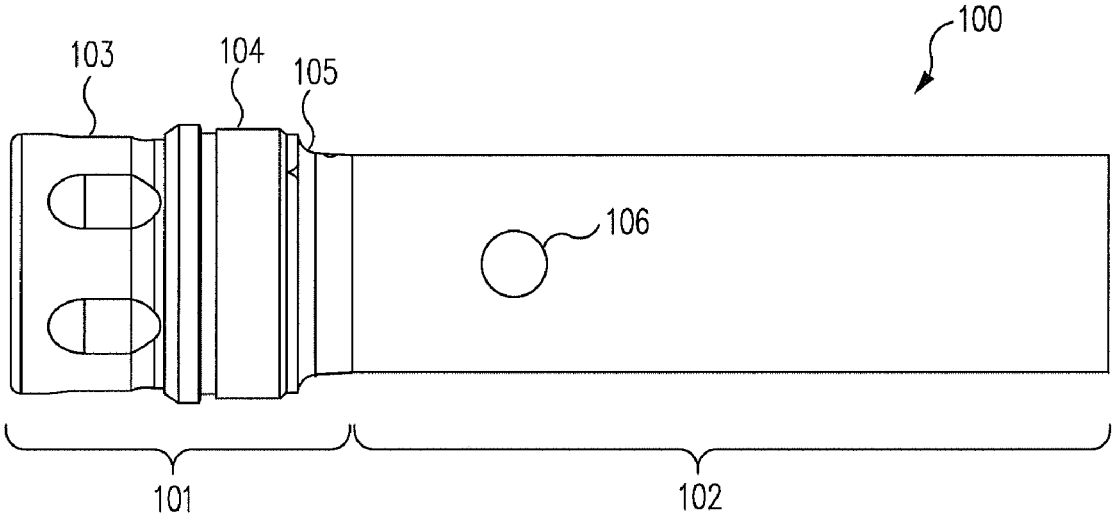
FIG. 1 is a side view of a multiple light emitting diode (LED) flashlight including a head and a body, in accordance with an embodiment of the invention.
Figure 2:
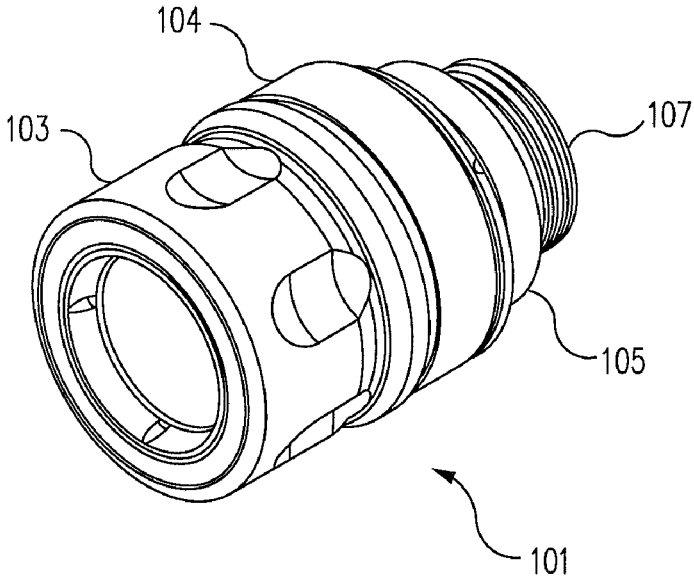
FIG. 2 is perspective view of the flashlight head of FIG. 1, in accordance with an embodiment of the invention.

Referring now to the drawings wherein the showings are for purposes of illustrating embodiments of the present invention only, and not for purposes of limiting the same, FIGS. 1-9 illustrate various aspects of a multiple light emitting diode (LED) flashlight 100 in accordance with various embodiments of the invention. However, light sources other than LEDs can be used and embodiments can include applications other than flashlights.

As shown in FIG. 1, flashlight 100 can include a light source or head 101, as well as a body 102. The head 101 can contain a plurality of LEDs and can be configured to facilitate switching therebetween. The body 102 can contain one or more batteries and can include a switch, such as a side pushbutton switch 106 and/or a tailcap pushbutton switch (not shown), for turning the flashlight 100 on and off. Any other desired type of switch can be used. For example, a toggle switch, a slide switch, and/or a variable output switch can be used. The head 101 can be attached to the body 102 via threads, as discussed below.

As shown in FIGS. 1-7, the flashlight head 101 can include a bezel 103. The bezel 103 can be rotatable with respect to the body 102 of the flashlight 100. Rotating the bezel 103 can effect the selection of a desired LED. For example, rotating the bezel 103 in one direction can select a white light LED and rotating the bezel 103 in the opposite direction can select an infrared (IR) LED. Although flashlight 100 is generally described herein as having two LEDs, any desired number of LEDs (e.g., three or more) may be used in other embodiments. Thus, any desired number, type, or combination of LEDs can be selected in this manner.

A lock ring 104 can lock the bezel 103 in position. For example, the lock ring 104 can lock the bezel 103 in a position that selects a white light LED or an infrared LED. The lock ring 104 can be configured such that it locks the bezel 103 in position when the lock ring 104 is positioned rearwardly (e.g., toward the body 102), and such that it allows the bezel 103 to rotate when the lock ring is positioned forwardly (e.g., away from the body 102). Thus, to select a desired LED, a user can push the lock ring 104 forward and rotate the bezel 103 to the desired position. The lock ring 104 can rotate along with the bezel 103.

Figure 3:
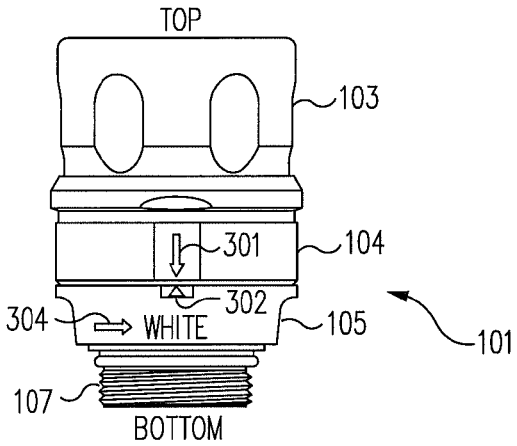
FIG. 3 is a side view of the flashlight head of FIG. 1 showing a bezel thereof positioned to provide white light, in accordance with an embodiment of the invention.
Figure 4:
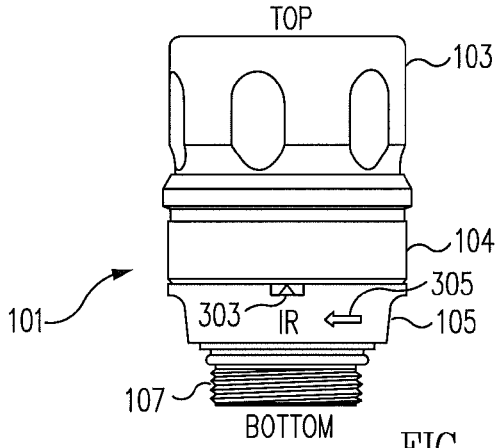
FIG. 4 is another side view of the flashlight head of FIG. 1 showing a bezel thereof positioned to provide white light, in accordance with an embodiment of the invention.

Referring now to FIGS. 3 and 4, indicia can be formed upon the flashlight head 101 to better facilitate the selection of a desired LED. For example, an arrow 301 can be formed upon the lock ring 104. The arrow 301 can provide an index to which corresponding indices formed upon a stationary (non-rotating) portion of the flashlight head 101 can be aligned to indicate which LED is selected. The arrow 301 formed upon the lock ring 104 can align with an index mark 302 (FIG. 3) to indicate that an LED that provides white light has been selected and can align with index mark 303 (FIG. 4) to indicate that an LED that provides infrared light has been selected. Index marks 302 and 303 can be formed upon a non-rotating heat sink 105 of the flashlight head 101, for example.

An arrow 304 can indicate the direction in which the bezel 103 can be rotated when the LED that provides white light has been selected (wherein such rotation changes the selection to the LED that provides infrared light). Similarly, an arrow 305 can indicate the direction in which the bezel 103 can be rotated when the LED that provides infrared light has been selected (wherein such rotation changes the selection to the LED that provides white light).

With particular reference to FIG. 3, the arrow 301 of the rotatable lock ring 104 (the lock ring 104 can rotate with the bezel 103, as mentioned above) is aligned with the index mark 302 of the heat sink 105. Alignment of the arrow 301 with the index mark 302 indicates that white light LED has been selected.

With particular reference to FIG. 4, the arrow 301 is not aligned with index mark 303. This indicates that the infrared (IR) LED has not been selected. The flashlight head 101 can be configured such that when the arrow 301 is not aligned with either index mark 301 or 302, then none of the LEDs are selected and the flashlight 100 is off.

Figure 5:
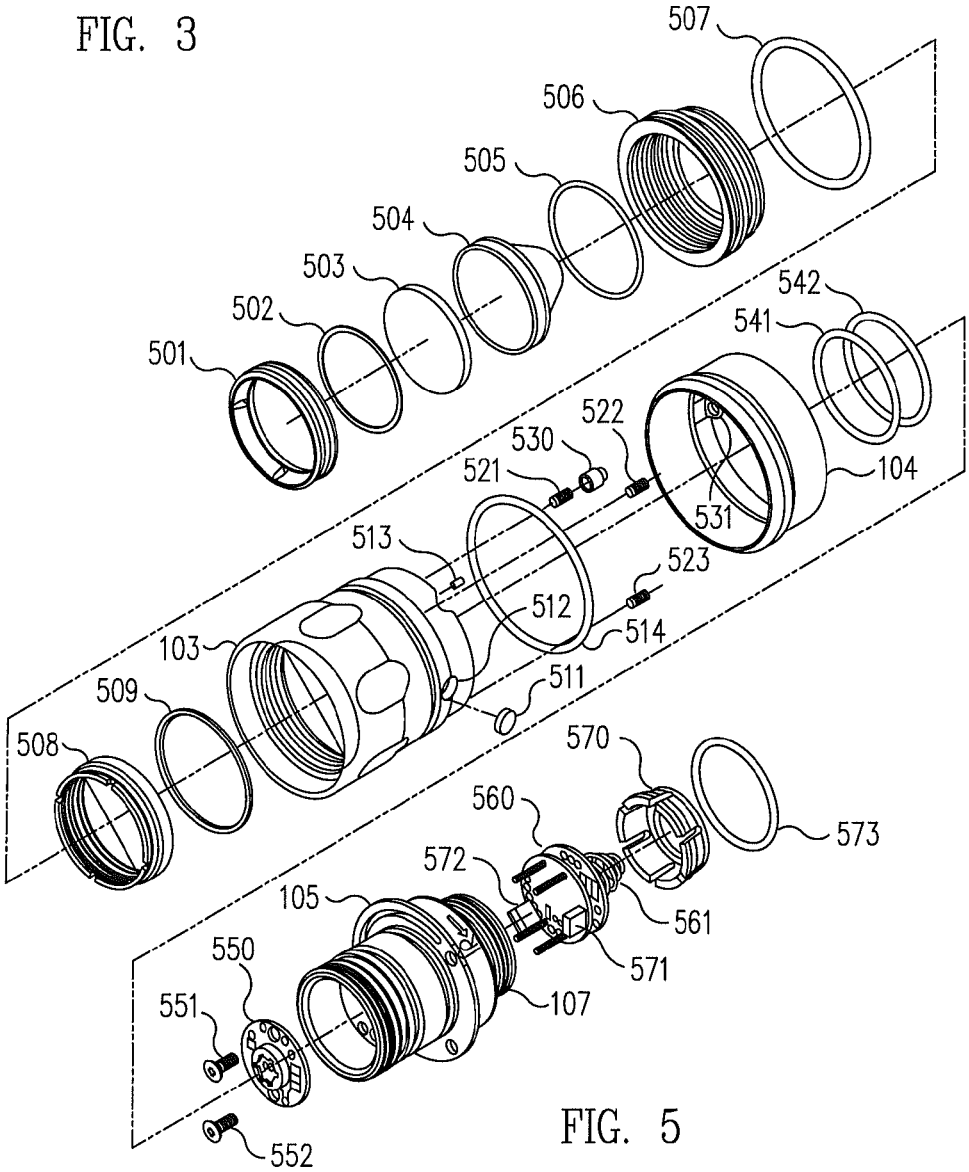
FIG. 5 is an exploded view of the flashlight head of FIG. 1, in accordance with an embodiment of the invention.

As shown in FIG. 5, the flashlight head 101 is shown in an exploded view. A lens retainer 501 can secure a planar lens 503 and a total internal reflection (TIR) lens 504 into a TIR housing 506. A flat gasket 502 can be disposed between the lens retainer 501 and the planar lens 503. An o-ring 505 can be disposed between the TIR lens 504 and the TIR housing 506. The lens retainer 501 can be threaded into the TIR housing 506 so as to capture the flat gasket 502, the planar lens 503, the TIR lens 504 and the o-ring 505 between the lens retainer 501 and the TIR housing 506.

The planar lens 503 can be a flat (plano-plano) lens. The planar lens 503 can be any other desired type of lens. The TIR lens 504 can be a solid optical element that uses total internal reflection to direct light from the selected LED to the planar lens 503. The planar lens 503 and the TIR lens 504 can be formed of glass, plastic, or any other desired material that is substantially transparent at the wavelengths of light produced by the LEDs. Indeed, any desired combination of material and types of lenses can be used.

The TIR housing 506 can thread into the bezel 103. An o-ring 507 can be captured between the TIR housing 506 and the bezel 103. The bezel 103 can include a magnet 511 that is disposed within an opening 512 of the bezel 103. A pin 513 can be attached to the bezel 103. The pin 513 can be received into a corresponding slot of the heat sink 105 so as to limit rotation of the bezel 103. For example, the pin 513 can cooperate with the slot to limit rotation of the bezel to approximately 135 degrees. The pin can be options. For example, the pin can be used to two LED configurations and can be omitted for three or more LED configurations. The bezel 103 can select one LED at one extreme of its rotation and can select another LED at the other extreme of its rotation.

Bezel retainer 508 can thread onto the heat sink 105 so as to capture and retain the bezel 103 upon the heat sink 105. Flat gasket 509 can be disposed between the bezel retainer 508 and the heat sink 105. The bezel 103 can have a bore (such as bore 651 of FIG. 6) that is off center or eccentric with respect to a centerline of the flashlight head 101. Thus, rotation of the bezel 103 can result in off center or eccentric rotation of the bezel 103, as well as of components attached to the bezel 103, such as the TIR lens 504.

An o-ring 514 can be captured between the bezel 103 and the lock ring 104. A plurality of springs (e.g., three springs 521-523) can bear upon the lock ring 104 and bezel 103 in a manner that tends to urge the lock ring 104 away from the bezel 103 (e.g., rearwardly) and that thus tends to maintain the lock ring 104 in the locked position thereof. That is, springs 521-523 can bias lock ring 104 toward the bottom of flashlight head 101.

Spring 521 can be received within detent 530. Detent 530 can be received within one of a plurality of holes, such as hole 531 of FIG. 6, to lock the bezel 103 into position with respect to the heat sink 105. Generally, the number of such holes can conform to the number of positions in which it is desired for the bezel 103 to lock into position. Generally, the number of such positions of the bezel 103 can conform to the number of different LED selections. For example, one of the holes, such as hole 531, can be used to lock the bezel 103 into the position for selecting the white light LED, as shown in FIG. 3, and another of the holes can be used to lock the bezel 103 into the position for selecting the infrared LED. The holes can be spaced apart by any desired distance. Thus, the distance or angle through which the bezel 103 is rotated to change LEDs can be any desired distance or angle.

Lock ring 104 can slide over and be slidably disposed upon bezel 103. In turn, bezel 103 can slide over and be rotatably disposed upon heat sink 105. Two o-rings 541 and 542 can be disposed upon heat sink 105, between the bezel 103 and heat sink 105. The two o-rings 541 and 542 can provide a bearing surface that facilitates rotation bezel 103 with respect to the heat sink 105.

Heat sink 105 can receive and mount LED printed circuit board (PCB) 550. LED PCB 550 can be attached to heat sink 105 via screws 551 and 552. LED PCB 550 can have the LEDs or groups of LEDs attached thereto. For example, one or more white light LEDs and one or more infrared LEDs can be attached to LED PCB 550. Heat sink 105 can function as a heat sink for LEDs that are attached to mount LED PCB 550. Thus, heat sink 105 can dissipate heat from the LEDs to other parts of the flashlight 100 and to ambient air.

Control printed circuit board (PCB) 560 can be received within the heat sink 105, such as within the end thereof that attaches to the flashlight body via threads 107. Control PCB 560 can include two stacked printed circuit boards. A spring 561 can facilitate electrical connection of the control PCB 560 to the batteries contained within the body 102 of the flashlight.

The control PCB 560 can include circuitry for determining which, if any, of the LEDs are to be illuminated and for illuminating the selected LED. Thus, control PCB 560 can receive electric power from the batteries and provide electric power to the selected LED.

More particularly, one or more Hall effect sensors can be attached to the control PCB 560 to sense position of the bezel 103. For example, two Hall effect sensors 571 and 572 can be attached to the control PCB 560 to sense the position of the magnet 511 that is attached to the bezel 103. In this manner, the position to which the bezel 103 has been rotated can be sensed to determine which LED is to be illuminated by the control PCB 560.

A spring insulator 570 can electrically insulate the contact spring 561 from conductive portions of the flashlight 100. For example, the spring insulator 570 can electrically insulate the contact spring 561 from the heat sink 105. An o-ring 573 can be disposed between the heat sink 105 and the body 102 of the flashlight 100.

Electric power from the batteries contained within the flashlight body 102 can be provided to the flashlight head 101 by spring 561 and by heat sink 105. Heat sink 105 can make electrical contact with the body 102 via threads 107. The body 102 can make contact with one terminal of the batteries. The spring 561 can make contact to the other terminal of the batteries.

Figure 6:
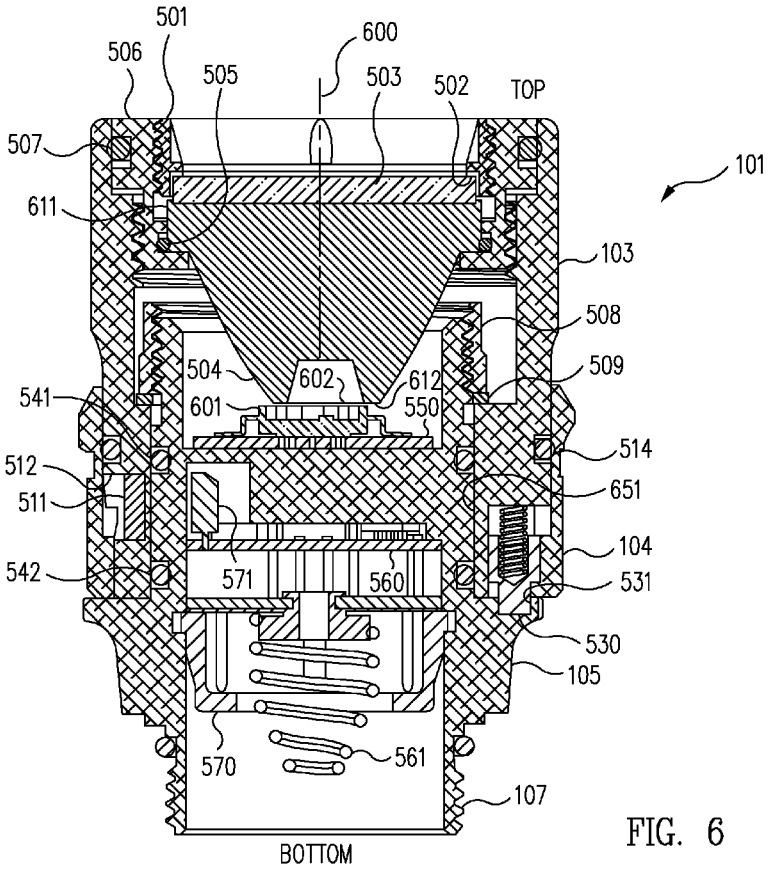
FIG. 6 is a cross-sectional side view of the flashlight head of FIG. 1, in accordance with an embodiment of the invention.

As shown in FIG. 6, an LED assembly 601 can include a plurality of LEDs that are attached to LED PCB 550. The LEDs of the LED assembly 601 can comprise one or more visible light LEDs, one or more infrared LEDs, and/or one or more ultraviolet LEDs. The LED assembly 601 can be configured such that the white light LEDs are grouped together and the infrared LEDs are grouped together.

The LED assembly 601 can be configured such that none of the LEDs are on the centerline 600 of the flashlight head 101. Thus, a white light LED and an infrared LED can both be off center with respect to the centerline 600 of the flashlight head 101. The white light LED and the infrared LED can both be off center with respect to the centerline 600 by the same amount and can both be disposed upon an arc defined by movement of the bottom end 612 of the TIR lens 504, as discussed in detail below.

The LED assembly 601 can similarly include other LEDs or groups of LEDs. For example, the LED assembly 601 can contain a group of red LEDs, a group of green LEDs, and/or a group of blue LEDs. The LED assembly 601 can include any desired number of groups of LEDs and each group of LEDs can include any desired number and/or combination of LEDs. Discussion herein of white light LEDs and infrared LEDs is by way of example only, and not by way of limitation.

The TIR lens 504 can be generally conical in configuration. The TIR lens 504 can have a larger or top end 611 that is proximate the planar lens 503 and can have a smaller or bottom end 612 that is proximate the LED assembly 601. The top end 611 and the bottom end 612 of the TIR lens 504 can be eccentric with respect the centerline 600 of the flashlight head 101. Thus, rotation of the TIR lens 504 can cause the TIR lens 504, and in particular the bottom end 612 of the TIR lens 504, to move in an arc. The LEDs can be disposed along this arc such that rotation of the TIR lens 504 moves the bottom end 612 thereof from one LED to another LED.

The TIR lens 504, and more particularly the bottom end 612 thereof, can be made to be eccentric or offset with respect to the centerline 600 of the flashlight head 101 by forming a bore 651 of the bezel 103 to be eccentric with respect to the centerline 600 of the flashlight head 101. Thus, as the bezel 103 is rotated with respect to the flashlight head 101, the TIR lens 504 moves in an arc, as described above.

The bottom end 612 can comprise a light inlet 602 that is configured to receive light from the LED assembly 601 into the TIR lens 504. The bottom end 612, and more particularly the light inlet 602, can move from one LED to another LED as the bezel 103 is rotated.

Thus, rotation of the TIR lens 504 can be caused by rotation of the bezel 103 to which TIR lens 504 is attached. Such movement can move the inlet 602 from being positioned proximate one LED of the LED assembly 601 to being positioned proximate another LED of the LED assembly 601. Thus, rotation of the bezel 103 can be used to select which LED of the LED assembly 601 provides light to the TIR lens 504. For example, when the light inlet 602 is positioned proximate a white light LED, then white light from the white LED enters the TIR lens 504 and the flashlight 100 provides white light. Similarly, when the light inlet 602 is positioned proximate the infrared LED, then infrared light from the infrared LED enters the TIR lens 504 and the flashlight 100 provides infrared light. Thus, the TIR lens 504 is movable between LEDs and the position of the inlet 602 determines from which LED the TIR lens 504 receives light.

Embodiments can be configured to facilitate locking of the bezel 103 in a desired position. For example, the bezel 103 can be locked in a position for the desired light, (e.g., white or infrared) to be provided by the flashlight 100. The lock ring 104 can be configured such that when the lock ring 104 is positioned toward the bottom of the flashlight head 101, then the bezel 103 is locked in position and rotation thereof is inhibited. Conversely, the lock ring 104 can be configured such that when the lock ring 104 is positioned toward the top of the flashlight head 101, then the bezel 103 is not locked in position, such that rotation thereof is facilitated. The springs 521-523 can bias the lock ring 104 in position toward the bottom of the flashlight head 101 such that the bezel 104 is locked unless the user moves the lock ring 104 toward the top of the flashlight head 101.

The lock ring 104 can interface with the bezel 103 such that the bezel 103 can only rotate if the lock ring 104 can rotate. For example, the lock ring 104 can interface with the bezel 103 via a plurality of splines. When the lock ring 104 is moved toward the top of the flashlight head 101, then detent 530 can be pulled by the lock ring 104 from opening 531 of heat sink 105 within which detent 530 is seated. When detent 530 is seated within opening 531, the bezel 103 is locked in position and rotation is inhibited. When detent 530 is pulled from opening 531, the bezel 103 is not locked in position and rotation is facilitated.

Embodiments can be configured so as to provide electric power only to selected LED. For example, electric power can be provided only to the LED that provides light to the TIR lens 504. Rotation of the bezel 103 can determine which LED is provided electric power.

Figure 7:
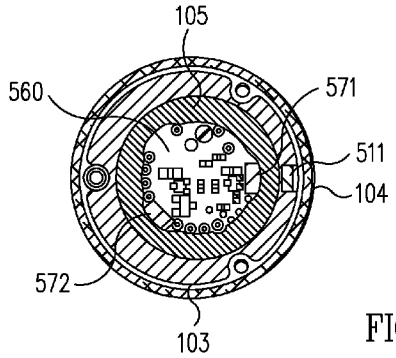
FIG. 7 is a cross-sectional top view of the flashlight head of FIG. 1, in accordance with an embodiment of the invention.

As shown in FIG. 7, one or more Hall effect sensors can cooperate with one or more magnets to sense rotation of the bezel 103 and thus to facilitate selection of the desired LED that is to be provided electrical power and thus illuminated. For example, Hall effect sensors 571 and 572 (which are attached to the control PCB 560) can be fixed with respect to the heat sink 105. Magnet 511 (which is attached to the bezel 103) rotates with bezel 103. Thus, rotation of the bezel 103 can move the magnet from proximate one Hall effect sensor 571, 572 to proximate the other Hall effect sensor 572, 571. Each Hall effect sensor 571 and 572 can sense the presence of the magnet 511, thus facilitating the use of rotation of the bezel 103 to select which LED receives electric power.

In various embodiments, any desired combination of control of electrical power and alignment of the TIR lens 504 with an LED can be provided by rotation of the bezel 103. Thus, for example, rotation of the bezel 103 can both align the TIR lens 504 with the LED that provides the desired output (e.g., white light or infrared light), and can facilitate the application of electric power to the same LED.

Figure 8:
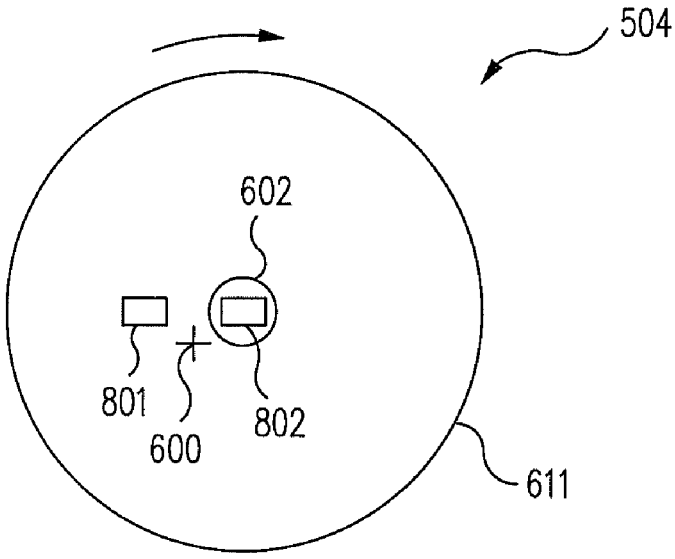
FIG. 8 is a schematic representation of the flashlight head of FIG. 1 showing relative positions of a light inlet and LEDs when the lens is in a first position, in accordance with an embodiment of the invention.
Figure 9:
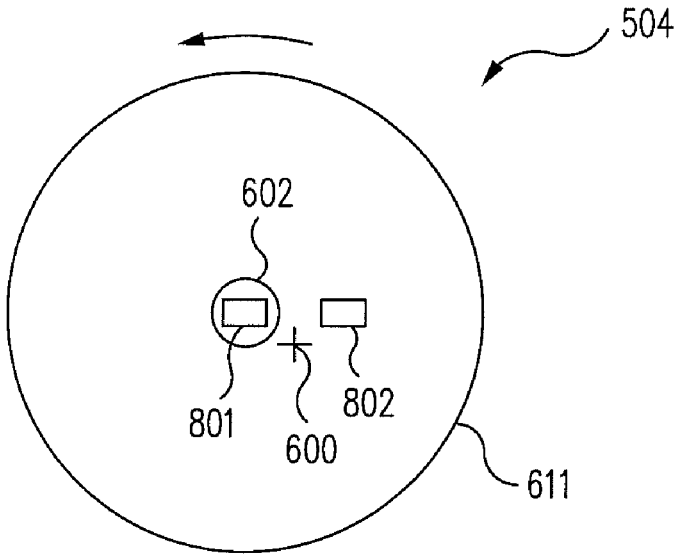
FIG. 9 is a schematic representation of the flashlight head of FIG. 1 showing relative positions of a light inlet and LEDs when the lens is in a second position, in accordance with an embodiment of the invention.

FIGS. 8 and 9 are top views that show schematically how rotation of the TIR lens 504 (such as rotation caused by rotation of the bezel 103) facilitates the selection of one of two different LEDs, according to an embodiment. The eccentricity of the TIR lens 504 has been exaggerated in FIGS. 8 and 9, so as to more clearly show how such eccentricity facilitates the selection of the desired LED. As discussed herein, any desired number of such LEDs can be selected from in this manner. For example, two, three, four, or more LEDs can be selected from in this manner.

FIG. 8 shows the TIR lens 504 rotated in the direction of the arrow such that light inlet 602 thereof is proximate (e.g., above) infrared LED 802. FIG. 9 shows that rotation of TIR lens 504 in the direction of the arrow results in movement of light inlet 602 from the infrared LED 802 to the white light LED 801. The TIR lens 504 is offset or eccentric with respect to the centerline 600 of the flashlight head 101 such that the position of the TIR lens 504 changes substantially between FIGS. 8 and 9. More particularly, the bottom end 612 and the light inlet 602 of the TIR lens 504 change positions substantially between FIGS. 8 and 9. This change in position occurs because the TIR lens 504 is substantially eccentric with respect to the centerline 600 and rotates about the centerline 600.

The structural components of the flashlight 100 can be formed of a metal, such as aluminum, magnesium, or steel. Alternatively, these structural components can be formed of a durable plastic, such a polycarbonate or acrylonitrile butadiene styrene (ABS). The structural components proximate the magnet 511 (e.g., the bezel 103 and the heat sink 105) can be formed of a non-ferrous material such that sensing of the magnet 511 by the Hall effect sensors 571 and 572 is not substantially inhibited thereby.

In view of the present disclosure, it will be appreciated that various structures are provided which may be advantageously used in one or more flashlights. For example, as discussed above, the TIR reflector can be configured so as to facilitate selection of which LED provides light for the flashlight. In addition, the inclusion of Hall effect sensors can be used to facilitate the determination of which LED illuminates during operation of the flashlight. Thus, a lens can be switched among one or more LEDs and electric power can be switched among one or more LEDs. In this manner, a user can readily select which LED is used by the flashlight and consequently what type of light (e.g., white light or infrared light) is provided thereby.

Figure 10:
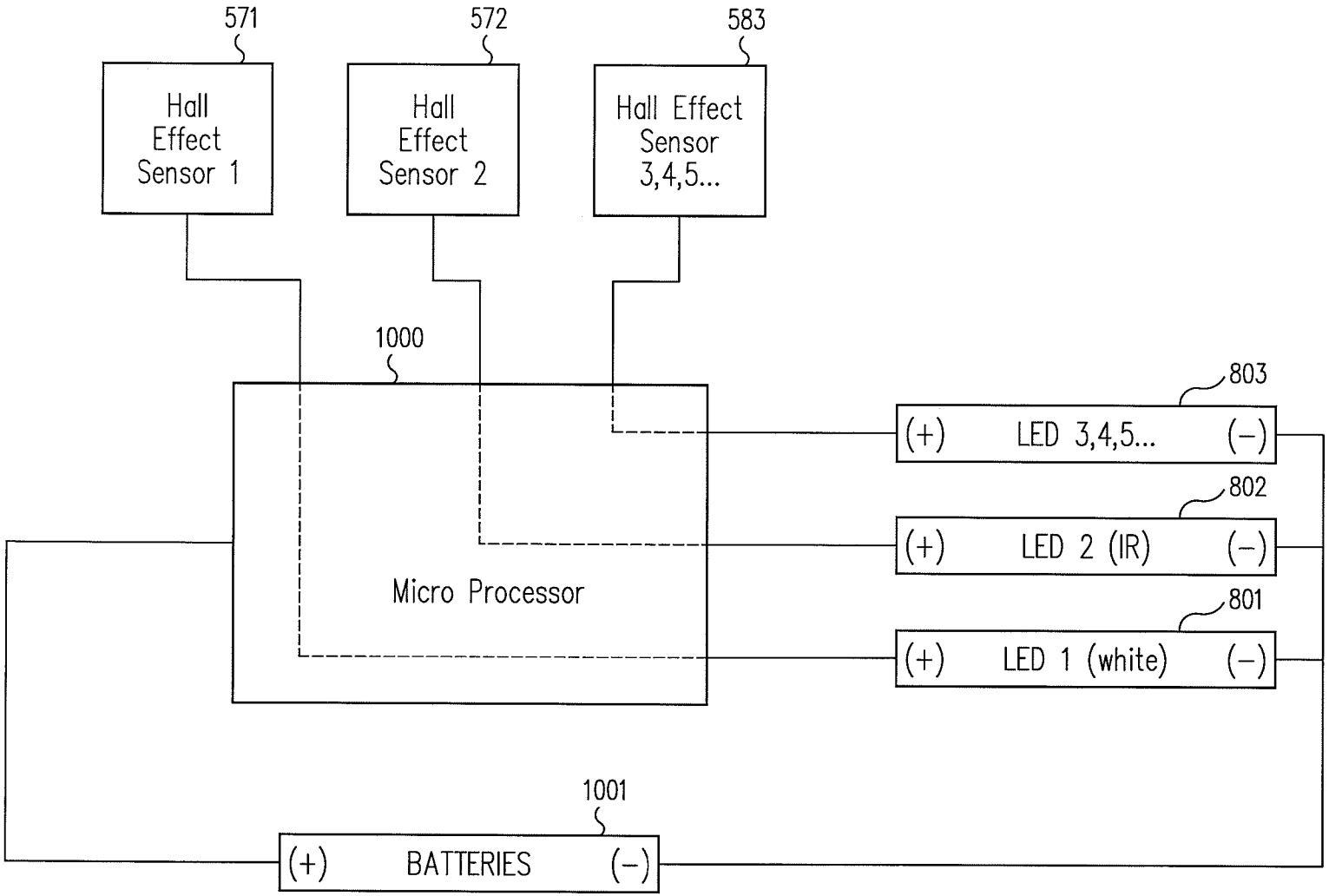
FIG. 10 is an electrical schematic of a flashlight head, in accordance with an embodiment of the invention.

FIG. 10 shows that first Hall effect sensor 571 and second Hall effect sensor 572 can provide inputs to microprocessor 1000. Any desired number of additional Hall effect sensors 583 can similarly provide inputs to microprocessor 1000. When microprocessor 1000 receives an input from a Hall effect sensor, 571, 572, and/or 583, then microprocessor 1000 facilitates the application of electric power from battery 1001 to a corresponding LED 801, 802, and/or 803. Optionally, an on/off switch (such as on/off pushbutton switch 106 of FIG. 1) can facilitate control of the electrical power from battery 1001.

In operation, the flashlight 100 can be turned on and off with pushbutton switch 106. A selection can be made between white light and infrared light by pushing the lock ring 104 forward (toward the top of the flashlight head 101) and rotating the bezel 103 to a position that causes the desired LED to illuminate. The lock ring 104 can then be released such that it inhibits further rotation of the bezel 103.

The use of a single white light LED and a single infrared LED is discussed herein. Such discussion is by way of example only and not by way of limitation. Any desired number of white light LEDs, infrared LEDs, and/or other LEDs can be used. The LEDs can be grouped in any desired manner. For example, one group can comprise only white light LEDs that cooperate to provide white light when white light is selected and another group can comprise only infrared LEDs that cooperate to provide infrared light when infrared is selected.

The foregoing disclosure is not intended to limit the present invention to the precise forms or particular fields of use disclosed. It is contemplated that various alternate embodiments and/or modifications to the present invention, whether explicitly described or implied herein, are possible in light of the disclosure. For example, it is contemplated that the various embodiments set forth herein can be combined together and/or separated into additional embodiments where appropriate.

Embodiments are not limited to the use of LEDs as light sources. Light sources other than LEDs can be used. For example, light sources such as LEDs, arc lamps, tungsten lamps, or any other type of light sources can be used. Thus, discussion herein regarding the use of LEDs is by way of example only and not by way of limitation. Embodiment can include any desired light sources or combination of light sources.

The lens that moves eccentrically does not have to be a TIR lens. Thus, discussion herein regarding the use of a TIR lens is by way of example only and not by way of limitation. Any desired type of lens can be used. Any desired combination of types of lenses and types of light sources can be used.

Embodiments are not limited to use in flashlights. Discussion herein of flashlights is by way of example only and not by way of limitation. Embodiments can be configured for use with flashlights, weapon (such as rifles and pistols) mounted lights, helmet mounted lights, headlamps, and vehicle lights. Indeed, embodiments can be used with any desired device. Thus, embodiments can provide light source switching for a variety of different applications.

For example, the flashlight head described herein can be configured to mount to a flashlight, a rifle or pistol, a helmet, a vehicle, or any other item. The flashlight head can mount to such items via threads, as described about. The flashlight head can mount to such items via an adapter to which the flashlight head attaches, wherein the adapter is configured to mount to the selected item.

Having thus described embodiments of the present invention, persons of ordinary skill in the art will recognize that changes may be made in form and detail without departing from the scope of the invention. Thus the invention is limited only by the following claims.

What is claimed is:

1. A device comprising:

a plurality of light sources;

a bezel offset from a centerline of the device and configured to rotate eccentrically about the centerline; and a lens substantially concentric with the bezel and configured to rotate with the bezel eccentrically about the centerline from a first position proximate a first one of the light sources to a second position proximate a second one of the light sources, wherein the lens is configured to receive light from the first one of the light sources when in the first position and receive light from the second one of the light sources when in the second position.

2. The device of claim 1, wherein the lens moves in an arc as the lens is rotated and wherein the light sources are disposed generally upon the arc.

3. The device of claim 1, wherein the lens comprises a total internal reflection lens.

4. The device of claim 1, wherein the first and second light sources have different outputs.

5. The device of claim 1, wherein the first and second light sources have different wavelengths of outputs.

6. The device of claim 1, wherein the first light source has a substantially white light output and the second light source has a substantially infrared output.

7. The device of claim 1, wherein the bezel is configured to switch electric power between the light sources when the bezel is rotated.

8. The device of claim 1, further comprising at least one Hall effect sensor configured to sense a position of the bezel to facilitate switching of electric power between the light sources.

9. The device of claim 1, further comprising:

at least one Hall effect sensor; and a magnet attached to the bezel such that rotation of the bezel moves the magnet so as to cause the at least one Hall effect sensor to switch electric power between light sources.

10. The device of claim 1, wherein the bezel is configured to rotate so as to facilitate which light source receives electric power; and wherein the device further comprises a lock ring that is configured to inhibit rotation of the bezel when the lock ring is in a first position and that is configured to facilitate rotation of the bezel when the lock ring is in a second position.

11. The device of claim 1, wherein the light sources and the lens at least partially define a head.

12. The device of claim 1, wherein the light sources and the lens at least partially define a flashlight head.

13. The device of claim 1, wherein the light sources and the lens at least partially define a head that is configured to mount to a weapon.

14. The device as recited in claim 1, wherein the light sources comprise LEDs.

15. The device of claim 1, wherein the lens comprises a single substantially conical lens.

16. A device comprising:

a plurality of light sources;

a bezel offset from a centerline of the device and configured to rotate eccentrically about the centerline;

a lens substantially concentric with the bezel and configured to rotate with the bezel eccentrically about the centerline from a first position proximate a first one of the light sources to a second position proximate a second one of the light sources, wherein the lens is configured to receive light from the first one of the light sources when in the first position and receive light from the second one of the light sources when in the second position;

a magnet attached to the bezel; and at least one Hall effect sensor configured to sense a position of the magnet to facilitate switching of electric power between the light sources.

17. The device of claim 16, wherein the at least one Hall effect sensor comprises two Hall effect sensors that are configured to sense two different positions of the magnet so as to facilitate switching of electric power between the first and second light sources.

18. The device of claim 16, wherein the light sources comprise LEDs.

19. The method of claim 16, wherein the lens comprises a total internal reflection lens.

20. The method of claim 16, wherein the lens comprises a single substantially conical lens.

21. A method for switching between light sources of a device, the method comprising:

rotating a bezel of the device, wherein the bezel is offset from a centerline of the device and configured to rotate eccentrically about the centerline;

wherein the rotating the bezel causes a lens of the device to rotate with the bezel eccentrically about the centerline from a first position proximate a first one of the light sources to a second position proximate a second one of the light sources; wherein the lens receives light from the first one of the light sources when in the first position and receives light from the second one of the light sources when in the second position; and wherein the lens is substantially concentric with the bezel.

22. The method of claim 21, wherein rotating the bezel switches electric power from the first light source to the second light source.

23. The method of claim 21, wherein the light sources comprise LEDs.

24. The method of claim 21, wherein the lens comprises a total internal reflection lens.

25. The method of claim 21, wherein the lens comprises a single substantially conical lens.

* * * * *